United States Patent [19]

Tamura et al.

[11] 4,333,124

[45] Jun. 1, 1982

[54] ELECTRICALLY DISCHARGING METHOD AND DEVICE

[75] Inventors: Yasuyuki Tamura; Kimio Nakahata; Masato Ishida, all of Kawasaki, Japan

[73] Assignee: Canon Kabushiki Kaisha, Tokyo, Japan

[21] Appl. No.: 75,969

[22] Filed: Sep. 17, 1979

Related U.S. Application Data

[63] Continuation of Ser. No. 840,158, Oct. 7, 1977, abandoned.

[30] Foreign Application Priority Data

Oct. 18, 1976 [JP] Japan ..... 51-124543

[51] Int. Cl.[3] ..... H01T 19/00

[52] U.S. Cl. ..... 361/214; 361/212; 355/3 CH

[58] Field of Search ..... 361/213, 214, 212, 235, 361/195, 196; 250/324, 325, 326; 355/3 CH, 3 R, 3 DD; 96/1 C, 1 A

[56] References Cited

U.S. PATENT DOCUMENTS

| | | | |
|---|---|---|---|
| 3,666,363 | 5/1972 | Tanaka et al. . | |
| 3,684,364 | 8/1972 | Schmidlin | 361/235 X |
| 3,698,926 | 10/1972 | Furuichi | 355/3 DD X |
| 3,714,531 | 1/1973 | Takahashi | 361/235 X |
| 3,716,754 | 2/1973 | Weber et al. | 361/213 |
| 3,912,989 | 10/1975 | Watanabe et al. | 361/235 X |
| 4,071,361 | 1/1978 | Marushima | 430/54 |

*Primary Examiner*—Patrick R. Salce
*Attorney, Agent, or Firm*—Fitzpatrick, Cella, Harper & Scinto

[57] ABSTRACT

A charged body is electrically discharged by the use of AC corona discharge, whereafter the AC corona discharge current is gradually attenuated before the discharging is stopped, and then the corona discharge is stopped.

6 Claims, 11 Drawing Figures

ELECTRICALLY DISCHARGING METHOD AND DEVICE

This is a continuation of application Ser. No. 840,158, filed Oct. 7, 1977, now abandoned.

BACKGROUND OF THE INVENTION

1. Field of the Invention

This invention relates to an electrically discharging method and device utilizing AC corona discharge.

2. Description of the Prior Art

As a device for removing imparted charge from the surface of a positively or negatively charged insulative material or electrophotographically sensitive plate (hereinafter referred to as the charged body, which means the body to be discharged), there has hitherto been a device in which an AC corona discharger is disposed in opposed relationship with the charged body and an AC high voltage is supplied to the discharger as it is moved relative to the charged body.

Also, in some of the well-known image transfer type electrophotographic apparatuses wherein a photosensitive medium is repetitively used to produce copies, the surface of the photosensitive medium is discharged after completion of a sequence of processes of charging, exposure, development and image transfer and before stoppage of the apparatus, thereby preventing irregularities of image from being created during the subsequent sequence of processes. See U.S. Pat. No. 3,698,926, for example.

However, AC corona discharge, if stopped immediately after the discharging operation, might sometimes cause some portions of the charged body to be non-uniform in potential. This will be explained by reference to FIG. 1 of the accompanying drawings which shows an electric circuit equivalent to a AC corona discharge.

In FIG. 1, R1 corresponds to the resistance of the space between a corona discharger and a charged body, and C1 corresponds to the electrostatic capacity between the charged body and the ground. The state of the charged body having been charged corresponds to the state of the capacitor C1 having been charged. If corona discharge is then effected actively, the resistance R1 of the space will be reduced to permit the release of the charge so far stored in the electrostatic capacity C1 of the charged body.

On the other hand, in a state that AC corona discharge is still continued after the discharging has been completed, the potential difference Vc across the capacitor C1 is expressed as $V_c = A/jWCR1 + 1 \sin Wt$ (j in the unit of imaginary number), where the applied voltage V is $V = A \sin Wt$ (A is the maximum value). In this equivalent circuit, the amplitude of the potential difference across the capacitor is $2A/\sqrt{1+W^2C^2R1^2}$. Thus, after completion of the discharging, the surface potential of the charged body may be regarded as having been varied in the range from an upper to a lower limit determined by $\pm A/\sqrt{1+W^2C^2R1^2}$.

Therefore, if corona discharge is abruptly discontinued with the charged body being opposed to the discharger, the then surface potential is somewhere in the range from the upper to the lower limit determined by $\pm A/\sqrt{1+W^2C^2R1^2}$ and this will later present itself as a portion of non-uniform potential.

This will further be considered. Particularly, in the case of an apparatus wherein an electrostatic latent image is formed on an insulative plate while during rotation, whereafter the latent image is developed into a visible image, which is then transferred to transfer paper and the insulative plate is subjected to AC corona discharge for removal of the charge therefrom and thus for reuse of the insulative plate, there is left in the insulative layer a peak potential of the aforementioned upper or lower limit when the apparatus is stopped from operating. This will result in irregularities of image when a subsequent processing cycle is executed.

Also, in an apparatus wherein a photosensitive plate comprising, as viewed from the surface thereof, an insulative layer, a photoconductive layer and a conductive layer, is subjected to primary charge and simultaneous exposure and AC discharging while being rotated to thereby form an electrostatic latent image on such photosensitive plate, whereafter the contrast of the latent image is increased by total surface exposure and then developed during the next step, followed by subsequent steps similar to those mentioned above for obtainment of a transfer image, there is created in the insulative layer a peak potential corresponding to the peak value of the AC field which leads to irregularities of the internal field within the photoconductive layer which is CdS or the like. Thus, the copying apparatus is left with an internal memory created therein. Such memory could result in irregularities of image unless it is removed before the next cycle of process is executed. The memory could not completely be erased without operation of the primary charger and AC discharger and without several tens of full rotations of the photosensitive medium.

SUMMARY OF THE INVENTION

It is an object of the present invention to provide an electrically discharging method and device which reduces the irregularities of discharge in a charged body.

It is another object of the present invention to provide an electrically discharging method and device whereby the surface potential of a charged body may be uniform after completion of electric discharge.

It is still another object of the present invention to provide an electrically discharging method and device whereby no localized peak potential is left on the surface of the charged body after completion of the electric discharge.

It is yet another object of the present invention to provide an image formation apparatus which enables a subsequent cycle of an electrostatic latent image formation process to be well performed.

It is a further object of the present invention to provide an image transfer type electrophotographic apparatus in which the photosensitive medium may be left with reduced irregularities of potential after the image transfer.

The above and other objects of the present invention will become fully apparent from the following detailed description of some embodiment thereof taken in conjunction with the accompanying drawings.

DESCRIPTION OF THE PREFERRED EMBODIMENTS

Figure 1:
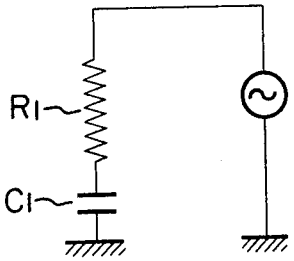
FIG. 1 diagrammatically shows an equivalent circuit for AC corona discharge.
Figure 2:
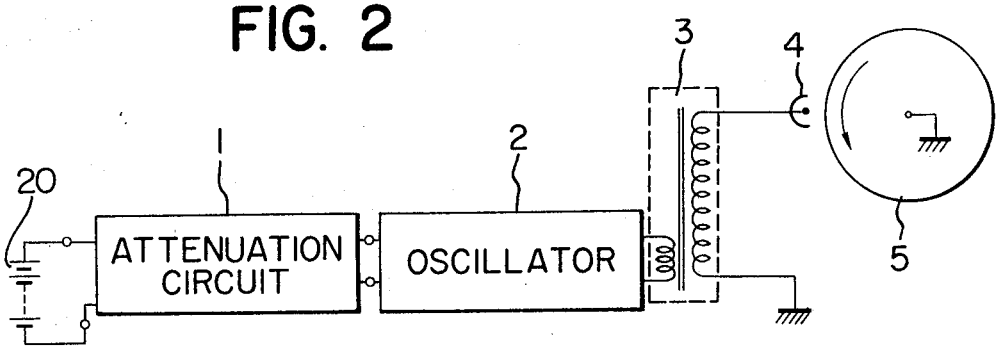
FIG. 2 is a block diagram showing the electrical discharging method and apparatus according to the present invention.

Referring to FIG. 2, direct current from a power source 20 is supplied through a circuit 1 to an oscillator 2, which thus generates an attenuating current of 200 Hz, and such attenuating current is boosted by a high voltage transformer 3 and supplied to an AC corona discharger 4 to remove surface potential of an insulative body 5. The AC corona discharger 4 is disposed in opposed relationship with the cylindrical insulative body 5, which comprises a plate of insulative material such as Myler or the like wrapped about a grounded cylindrical metal member.

The circuit 1 is designed so as to gradually reduce the high AC voltage applied to the AC corona discharger before the discharging is stopped. Reduction in the value of the high AC voltage applied to the AC corona discharger 4 reduces the amplitude of the potential difference between the insulative body and the ground. Accordingly, fluctuation of the surface potential of the insulative body is gradually decreased. When the voltage becomes lower than the AC corona on-set voltage, the operation of the AC discharger 4 is stopped. Thus, the surface potential after the discharging becomes uniform.

Reduction in the voltage applied to the corona discharger 4 not only reduces the potential on the insulative body, but also quickly reduces the fluctuation of the surface potential because the corona current abruptly becomes difficult to flow and the effective corona resistance of the space is increased.

Figure 3:
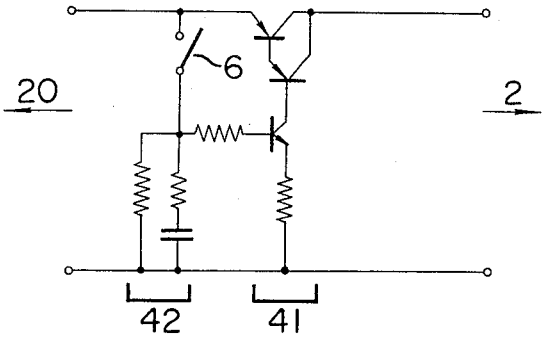
FIGS. 3, 5, 6 and 7 diagrammatically show examples of the circuit used in FIG. 2.

FIG. 3 shows the arrangement of the circuit 1. This comprises a switching circuit 41 provided by a semiconductor element and a time constant circuit 42. Closing of a contact 6 supplies direct current to the oscillator 2 and permits charge removal to be effected by AC corona discharge. Opening of the contact 6 attenuates the current at a predetermined time constant and finally stops the supply of the current. The AC output voltage of the high voltage transformer 3 is decreased in accordance with the decrease in the current supplied to the oscillator 2. The output of the circuit 1 may preferably correspond to the source voltage for the oscillator 2.

Figure 4:
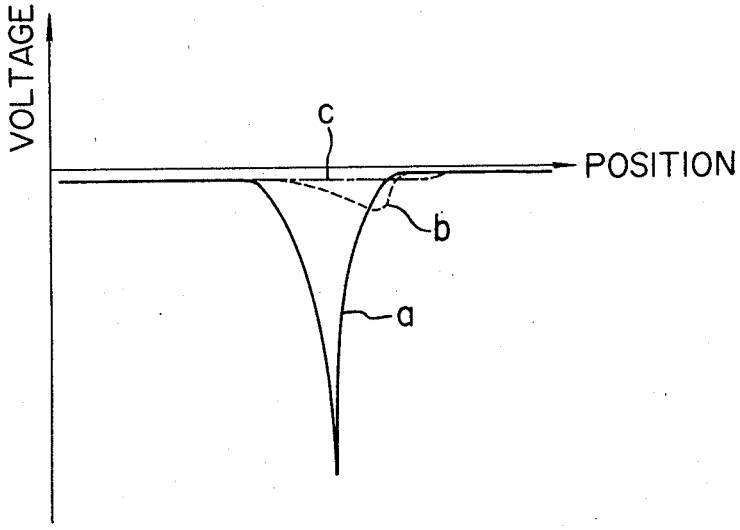
FIG. 4 is a graph illustrating the characteristics of the surface positions and the surface potentials.

The result of the test carried out with this device is shown in FIG. 4, wherein the ordinate represents the surface potentials of the insulative body and the abscissa represents the successive positions on the surface of the insulative body. In the discharger 4 used with this embodiment, the discharge width is 25 mm along the rotational axis of the insulative body 5, the velocity of movement of the insulative body is 20 cm/sec. and the discharge voltage is 7 kilovolts.

When the time constant of the circuit 42 was 0 sec. (a in FIG. 4), potential irregularities of at least 100 V occurred; when the time constant was 1/200 or more of a second, the potential irregularities became sharply smaller; when the time constant was 1/100 of a second (b in FIG. 4), the potential irregularities was decreased to 20 to 30 V; when the time constant was 1/10 of a second (c in FIG. 4), little or no potential irregularity was observed. Here, this effect was invariable even when the discharging was stopped during the relative movement of the insulative body 5 and the AC corona discharger 4, or even when the discharging was stopped after the rotation of the insulative body 5 was stopped.

If the time constant is set to 10 milliseconds or more, it is possible to eliminate the irregularities resulting from the peak potential.

Usually, the time required until the corona discharge is stopped by opening the power switch which controls ON-OFF of the discharger is 1 millisecond or less and therefore, potential irregularities cannot be eliminated.

Figure 5:
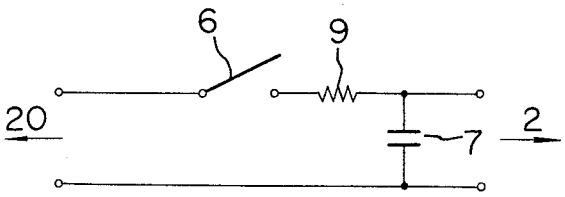
Figure 6:
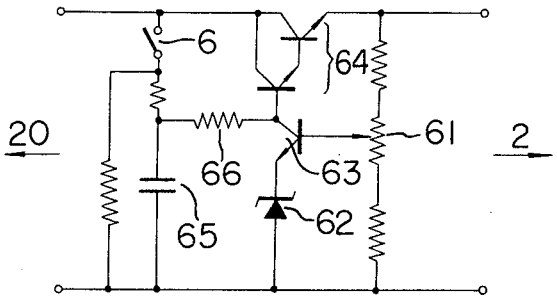

FIGS. 5 and 6 shows further forms of the circuit 1 for uniformly attenuating the DC input current.

The circuit of FIG. 5 attenuates the current by causing the current stored in a capacitor 7 for eliminating ripples of the DC power source 2 (FIG. 2) to be discharged after closing of the contact 6. A resistor 9 is provided to prevent the contact 6 from being damaged by a heavy current flowing at the moment contact 6 is closed.

In FIG. 6, a stabilizing circuit for making the DC voltage constant during operation and a circuit for uniformly attenuating the current during stoppage of the operation are made integral with each other. By closing the contact 6, the circuit of FIG. 6 acts as a stabilizing power source circuit and, once the contact 6 is opened, the current is uniformly attenuated to effect the discharging action free of the aforementioned potential irregularities. Designated by 61 is a resistor for detecting variations in output, 62 a reference voltage source, and 63 a transistor for controlling power supply to a control element 64 to form a predetermined output when the detected voltage differs from the reference voltage. Opening of the switch 6 causes gradual release of the charge from a capacitor 65 and accordingly, gradual drop of the bias voltage in the control element 64, thus finally resulting in gradual drop of the circuit output.

Figure 7:
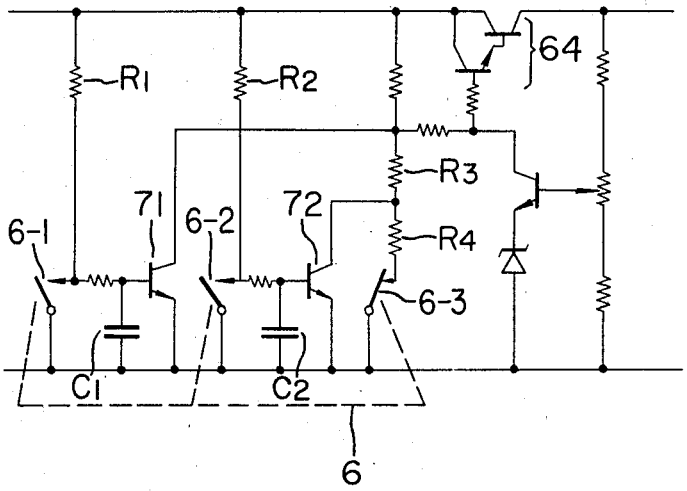

FIG. 7 shows a circuit for stepwisely attenuating the applied voltage with time and thereby reducing the surface potential irregularities of the insulative body to a sufficiently low practical level. The circuit is shown in its OFF position. The time constant is $R1C1 > R2C2$. Transistor 71 is charging a capacitor C1 through a resistor R1 and thus, it is in ON state, so that resistors R3 and R4 are being short-circuited. Consequently, the control element 64 in the stabilizing circuit does not operate. Next, when the switch 6 is closed and contacts 6-1 and 6-2 are closed, transistors 71 and 72 are turned off. Contact 6-3 is not closed, so that the stabilizing circuit performs its usual operation. Next, when the switch 6 is opened in an effort to stop corona discharge, the voltage reduced through resistors R3 and R4 is first applied as input to the base of the control element 64 by the contact 6-3, so that a lower voltage than before is put out. In a time R2C2, the capacitor C2 is charged, whereupon the transistor 72 is turned on and the voltage reduced by the resistor R3 provides a bias, so that still a lower voltage is put out. In a time R1C1, the transistor 71 is turned on, whereupon the control element 64 is turned off, so that the output of the circuit becomes null.

Figure 8:
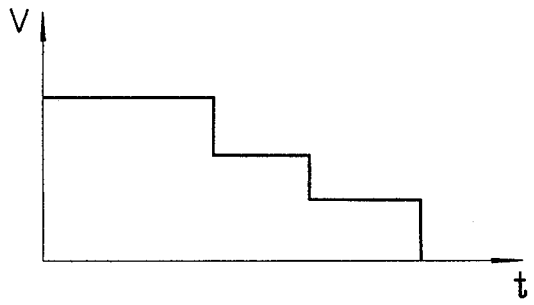
FIG. 8 is a graph illustrating the electrical discharging method carried out in FIG. 7.

FIG. 8 illustrates these variations in the relation to time and output.

It is also possible to prevent creation of potential irregularities by a method of gradually enlarging the spacing between the corona discharger and the charged body, or by a method using a member insertable between the AC corona discharger and the charged body and narrowing the passageway of corona ions between the discharger and the charged body of moving that member. In these instances, the procedure of enlarging the spacing between the AC corona discharger and the charged body or narrowing the passageway of corona ions requires a time corresponding to more than two to three cycles of the AC voltage. In short, the potential irregularities created on the charged body may be prevented by increasing the corona resistance in the space between the AC corona discharger and the charged body prior to the discharging being completely stopped.

It is also possible to prevent the potential irregularities created on the charged body by reducing the wavelength, or gradually increasing the frequency, of the high AC voltage applied to the AC corona discharger, prior to the discharging being completely stopped.

Figure 9:
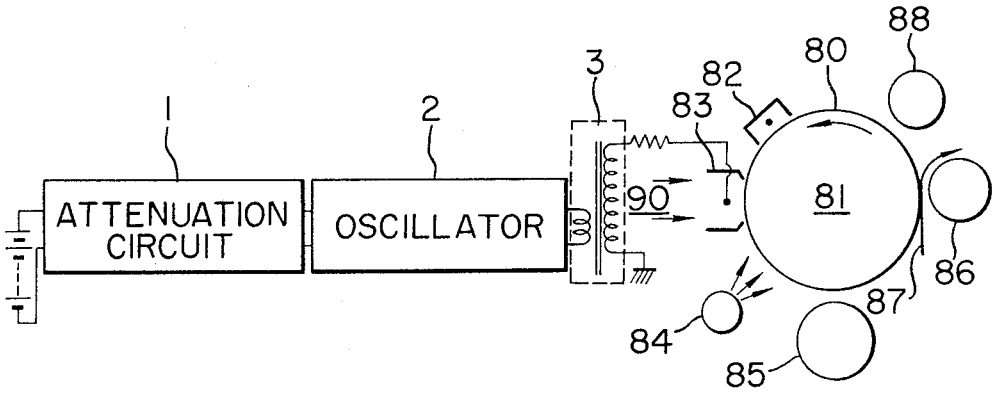
FIG. 9 is a block diagram of the present invention as applied to the electrophotographic process.

FIG. 9 shows an example of the present invention as applied to the well-known electrophotographic process using a three-layer photosensitive medium 80 (as viewed from its surface, an insulative layer 80*a*, a photoconductive layer 80*a* and a conductive layer 80*c*). According to this process, the photosensitive medium 80 provided on a drum 81 is subjected to primary charging of the positive or the negative polarity by a corona charger 82 while the drum 81 is rotated in the direction of arrow, whereafter the photosensitive medium is exposed to image light 90 and subjected to secondary charging by corona charger 83 to thereby remove the charge imparted during the primary charging and form an electrostatic latent image on the photosensitive medium. Further, the contrast of the latent image is enhanced by total surface exposure effected by a lamp 84, and then the latent image is developed into a visible image by toner in a developing device 85, whereafter the visible image is transferred to a sheet of plain paper 87 by means of a transfer roller 86 while any residual toner on the photosensitive medium is removed by cleaning means 88 such as blade or the like to make the photosensitive medium available for reuse.

Here, an AC corona discharger is used as the secondary charger 83 and even after the image transfer and the cleaning process, this AC corona discharger alone is continuously operated while the rotation of the drum 81 is continued, thereby removing the residual charge from the surface of the photosensitive medium, whereafter the switch 6 (FIG. 4) in the circuit 1 is opened to gradually reduce the AC output from the oscillator 2.

Thus, creation of potential irregularities may be prevented by utilization of the secondary charger 83.

Figure 10:
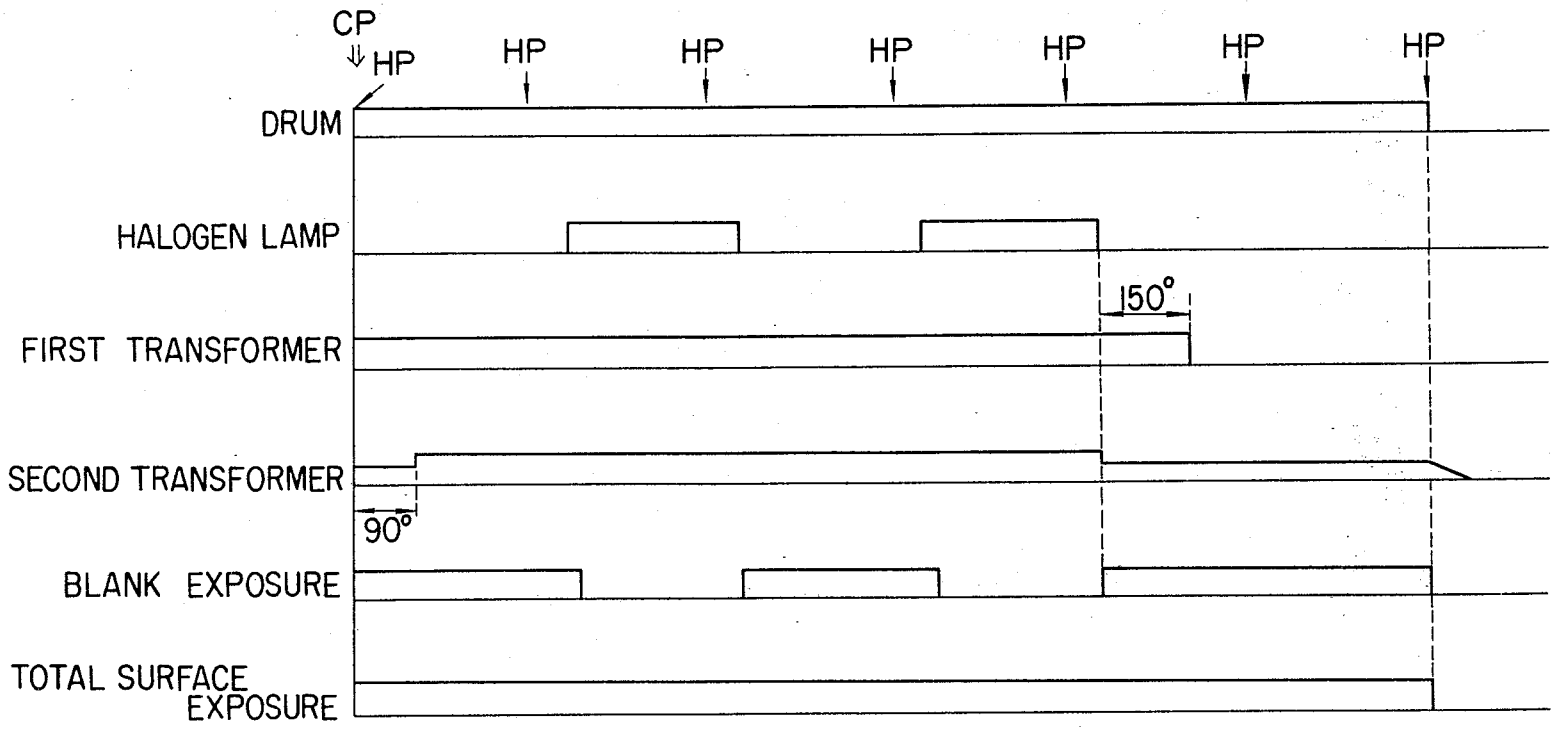
FIG. 10 is a chart of operation timing for FIG. 9.

FIG. 10 is a chart showing the timing between various processing means in the electrophotographic process.

Two transformers similar to the transformer of FIG. 2 are employed, the first of these transformers being connected through a rectifying circuit to a primary charger 82 and a transformer charger 86, and the second transformer being connected to an AC corona discharger 83. A blank exposure lamp is a lamp for illuminating the photosensitive medium to prevent unnecessary toner from being deposited on the photosensitive medium. HP means a predetermined position of the photosensitive drum 81. The chart refers to the case that two copies were produced. When copy button CP is depressed at the point of time shown, the drum starts rotating and from the second full rotation of the drum, a halogen lamp is turned on to start image exposure. The second transformer supplies a predetermined voltage to the AC discharger when the angle of rotation of the drum exceeds 90°, and changes over the output voltage when a second exposure is completed. The process of removing the residual charge is then entered. When the second HP signal is provided after completion of the exposure, the switch 6 (FIG. 3) is opened to cut off the AC discharger from the power source. Thereafter, the voltage is gradually attenuated until it becomes zero. The angle of 150° before the first transformer is turned off is the angle formed between the AC corona discharger and the transfer charger. By doing so, the surface potential of the photosensitive drum is made more uniform. The blank exposure lamp is designed to illuminate the surface of the photosensitive medium at the same time that the AC discharger 83 operates.

Figure 11:
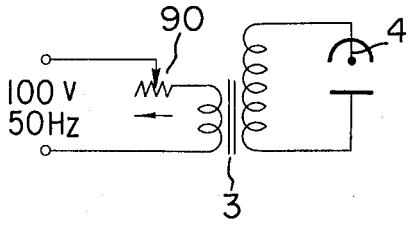
FIG. 11 shows another embodiment of the present invention.

The level to which the output of the second transformer is changed over upon completion of the exposure may be of such a degree as will reduce the degree of intensity to which one component of the AC corona discharge has so far been intensified.

Where a transformer for boosting commercially available power of 50 Hz 100 V is used as the power source of the discharger, attenuation of the output thereof may be accomplished by gradually increasing a slide resistance 90 after the opening of the switch 6, as shown in FIG. 11.

What we claim is:

1. An image formng method comprising the steps of:

electrically charging a recording medium to form an image thereon;

transferring the image on the recording medium onto a transfer medium;

electrically discharging the electric charge on the recording medium by applying a given AC voltage to an AC corona discharger after completion of the transfer operation to remove the residual charge on the recording medium; and gradually attenuating the AC voltage applied to said AC corona discharger, when the discharge of the residual charge is terminated, until it becomes zero.

2. A method according to claim 1, wherein the attenuating time of the AC voltage depends on the frequency thereof.

3. An image forming apparatus comprising:

a rotatable photosensitive medium;

means for forming an electrostatic latent image on said photosensitive medium;

means for developing said electrostatic latent image formed by said electrostatic latent image forming means;

means for transferring the image from said photosensitive medium to a transfer medium;

AC corona discharger means for applying AC corona discharge current to said photosensitive medium to remove any residual charge on said photosensitive medium after the image is transferred to the transfer medium by said transferring means; and attenuating means for gradually attenuating the AC voltage applied to said AC corona discharger, when the discharge of the residual charge is terminated, until it becomes zero;

thereby preventing nonuniformity of the discharge distribution over said photosensitive medium.

4. An apparatus according to claim 3, wherein said rotatable photosensitive medium comprises an insulative layer, a photoconductive layer and a conductive layer, said electrostatic latent image forming means comprises primary corona discharge means for providing primary charge to said photosensitive medium, secondary corona discharge means for discharging electric charge on said photosensitive medium at the same time that image exposure is provided, and means for uniformly exposing said photosensitive medium discharged by said secondary corona discharge means.

5. An apparatus according to claim 4, wherein said secondary corona discharge means is said AC corona discharge means.

6. An apparatus according to claim 4, wherein after the image was transferred from said photosensitive medium to the transfer medium, the AC corona discharge current applied to said photosensitive medium is varied in value compared with that at the time when image exposure is provided.

* * * * *

UNITED STATES PATENT AND TRADEMARK OFFICE

CERTIFICATE OF CORRECTION

PATENT NO. : 4,333,124

DATED : June 1, 1982

INVENTOR(S) : YASUYUKI TAMURA, ET AL.

It is certified that error appears in the above-identified patent and that said Letters Patent is hereby corrected as shown below:

Column 1, line 18, after "been" insert --utilized--;
line 68, after "plate" delete "while".

Column 5, line 27, change "80a" to --80b--.

Column 6, line 35, Claim 1, change "formng" to --forming--.

Signed and Sealed this

*Eighteenth* Day of *January 1983*

[SEAL]

*Attest:*

GERALD J. MOSSINGHOFF

*Attesting Officer*

*Commissioner of Patents and Trademarks*